United States Patent [19]

Furusawa

[11] 4,174,544

[45] Nov. 20, 1979

[54] STOOL FOR USE WITH INFANT

[76] Inventor: Noriko Furusawa, 1439, Torii-Atomachi, Kanuma-shi, Tochigi-ken, Japan

[21] Appl. No.: 914,543

[22] Filed: Jun. 12, 1978

[51] Int. Cl.[2] ..... A61G 9/00

[52] U.S. Cl. ..... 4/112; 4/137; 4/138; 4/141

[58] Field of Search ..... 4/134, 135, 136, 137, 4/140, 142, 138, 141, 139, 112

[56] References Cited

U.S. PATENT DOCUMENTS

| | | | |
|---|---|---|---|
| 2,498,576 | 2/1950 | Pourch et al. | 4/135 X |
| 2,552,002 | 5/1951 | Dunbar | 4/134 X |
| 2,602,166 | 7/1952 | Aitken | 4/141 |
| 3,020,528 | 2/1962 | Swanson, Jr. et al. | 4/135 |
| 3,268,916 | 8/1966 | Hix, Jr. | 4/138 |
| 3,364,478 | 1/1968 | Waard | 4/141 X |
| 3,715,549 | 2/1973 | Kraff | 4/1 |
| 4,069,522 | 1/1978 | Messmer et al. | 4/138 |

*Primary Examiner*—Henry K. Artis
*Attorney, Agent, or Firm*—Holman & Stern

[57] ABSTRACT

An infant training stool having a bed pan rockably carried therein. A music box is mounted in the base portion of the stool and is normally kept from playing by a biased stopper rod blocking the governor. In a first embodiment, the weight of the infant lowers the stopper rod allowing the music box to play. In the second, the weight of the infant's elimination lowers the internal bed pan lowering the stopper rod thereby allowing the music box to play.

2 Claims, 2 Drawing Figures

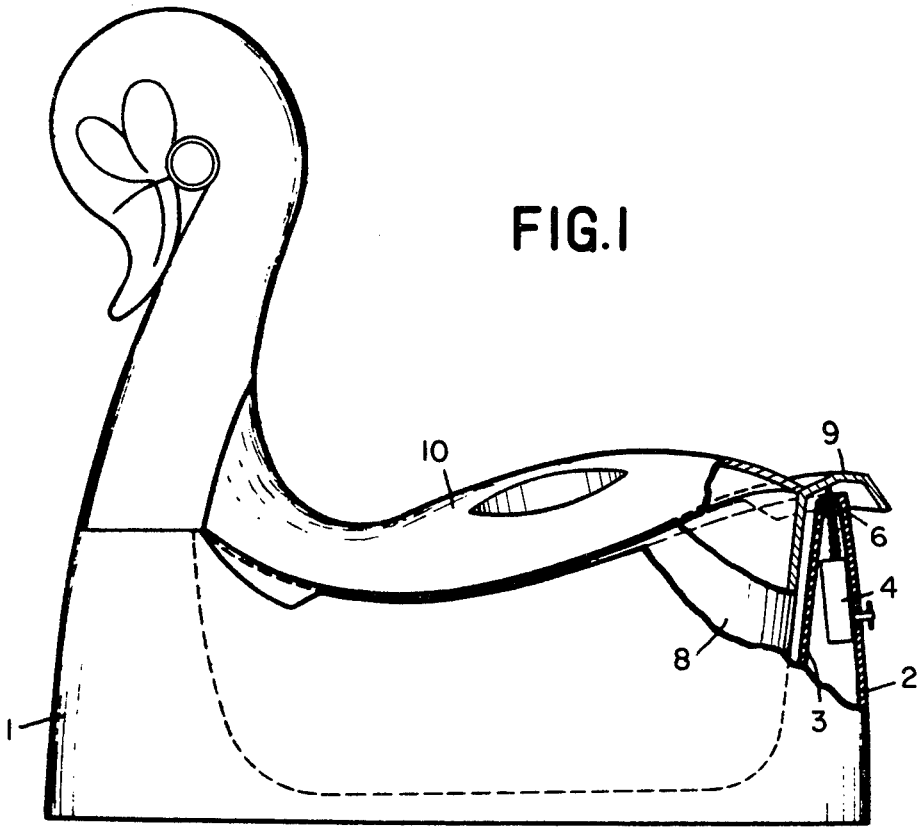
FIG.1
FIG.2
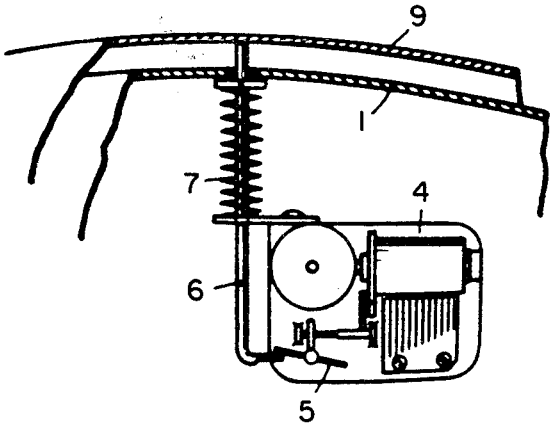

STOOL FOR USE WITH INFANT

The present invention relates to a stool for use with an infant, and more particularly to a stool in which a music box (Orgel) is accommodated.

Various infantile stools are known and many attempts have been made to improve the stools usually in the light of practical aspect and more specifically in the light of speciality with respect to a seated body construction or the like. However, there is still left room for improvement of stool in terms of taste, especially of musical effects. This invention has its object to cultivate the musical sense of infants to primarily achieve musical effects noted above.

It is another object of the invention to let the infant make regular defecations and micturitions.

It is a further object of the invention is to render defecation and micturition of infant smooth and to finish the defecation or micturition as desired without hurting interest of infant.

According to another aspect of the present invention, the stool of the invention serves as a guide for infants to excite defecation and micturition, thus offering a particular convenience to an attendant.

Still another object of the invention is to provide a stool, which is extremely simple in its construction and which has a noticeable difference in the infantile stool and handling the same and its cost from prior art infantile stools.

According to the present invention having those objects as noted above, there is provided a stool in which when an infant sits astride the stool, a music box incorporated therein starts to sound. Replacement of the music box and selection of location thereof may suitably be determined in accordance with interest of infant or subjective object of attendant, that is, educational object. It may also effectively select location, where the music box is mounted, in such a manner that a sound generating place is first selected and a mechanical operability is considered, for example, the music box incorporated in the stool starts to sound as the infant sits astride thereon, and in addition, the music box makes a sound as the infant makes defecation or micturition after sat astride on the stool.

These and other objects, features and advantages of the invention will become more apparent upon a reading of the following detailed specification and drawings, in which:

FIG. 1 is a side view of an infantile stool according to the present invention with partially and especially a music box mounting portion cut away; and FIG. 2 is an enlarged cutaway side view of a typical music box mounting portion of FIG. 1.

As is best seen from FIGS. 1 and 2, an infantile stool according to the present invention consists in that a music box 4 is encased between an outer peripheral wall 2 and an inner peripheral wall which form a base 1, a stopper rod 6 adapted to stop rotation of a governor 5 of the music box 4 is raised and extended through the top surface of the base 1 under pressure by means of a spring 7, and a bed-pan 8 received in the inner peripheral wall 3 is retained in the top surface at an extended side edge 9, the stopper rod 6 raised under pressure pushing up the extended side edge 9. A lid is shown as at 10.

As previously described, in the present invention, the music box 4 is mounted within the base 1, the governor 5 of the music box is prevented from being rotated by the stopper rod 6 raised under pressure by means of the spring 7, and the top end of the stopper rod 6 pushes up the extended side edge 9 formed in the bed-pan 8 extending through the base 1, with the result that when not in use, the music box will never make a sound but when in use, the weight of infant's body causes the side edge 9 of the pan 8 to move the stopper rod 6 downwardly against the spring 7 so that the governor 5 rotates to sound the music box 4.

As is evident from the foregoing, the present invention provides a simple arrangement wherein the extended side edge 9 is provided on the bed-pan 8 to receive the weight, whereby the music box sounds when the infant makes defecation or micturition to psychologically and physiologically assist the infant who makes defecation or micturition and to further stimulate infant's interest therein. More specifically, the present invention may achieve particular effects to fall infants into the habit of making defecation or micturition at a predetermined time.

It is to be understood that the form of mounting the music box 4 herein shown and described is to be taken as a typical embodiment and that various changes in design thereof may be anticipated by the inventor of the present invention. For example, the operating direction of the stopper rod 6 to the aforesaid governor 5 is arranged undersurface of the bed-pan 8 and the pan 8 is resiliently held by means of another spring (for example, in a manner of using the aforesaid spring 7), whereby the music box 4 may sound as the infant makes defecation or micturition after sat astride on the stool.

What is claimed is:

1. A stool for use with infants which is portable and used in sit-astride fashion comprising:

a bed pan having a bottom surface and an extended side edge with an undersurface, a straddle seating body having a base portion and a lid with a center opening, said base portion having an inner peripheral wall and an outer peripheral wall, said bed pan being rockably carried in said base portion, a music box mounted between said inner and outer perpheral walls having a rotatable governor, a stopper rod having two ends longitudinally movably mounted in said base portion, one end being in contact with said undersurface of said side edge and the other end being in rotation-blocking contact with said governor, and a spring biasing said stopper rod into contact with said governor whereby when an infant is placed astride said lid, said stopper rod is pushed downwardly against the biasing of said spring unblocking said governor and allowing the same to rotate to sound said music box.

2. A stool for use with infants which is portable and used in sit-astride fashion comprising:

a bed pan having a bottom surface and an extended side edge with an undersurface, a straddle seating body having a base portion and a lid with a center opening, said base portion having an inner peripheral wall and an outer peripheral wall, said bed pan being rockably carried in said base portion, a music box mounted between said inner and outer peripheral walls having a rotatable governor, a stopper rod having two ends longitudinally movably mounted in said base portion, one end being in contact with said bottom surface of said bed pan and the other end being in rotation-blocking contact with said governor, a first spring biasing said bed pan upwardly, and a second spring biasing said stopper rod into contact with said governor whereby when an infant astride said lid eliminates, said bed pan is displaced downwardly against the biasing of said first spring by gravity pushing said stopper rod against the biasing of said second spring unblocking said governor and allowing the same to rotate to sound said music box.

* * * * *